US005675844A

United States Patent [19]

Guyton et al.

[11] Patent Number: 5,675,844

[45] Date of Patent: Oct. 14, 1997

[54] CUSHIONED PROTECTIVE APPAREL

[76] Inventors: Daniel Printz Guyton, 3961 N. Shore Dr., Akron, Ohio 44333; Douglas McCullough Evans, 946 Monmouth Dr., Akron, Ohio 44313

[21] Appl. No.: 596,495

[22] Filed: Feb. 5, 1996

[51] Int. Cl.[6] ..... A41D 13/00

[52] U.S. Cl. ..... 2/455; 2/411; 2/412; 2/414; 2/22

[58] Field of Search ..... 2/411, 2, 412, 2/413, 414, 22, 445

[56] References Cited

U.S. PATENT DOCUMENTS

| | | | |
|---|---|---|---|
| 1,652,776 | 12/1927 | Galanis | 2/411 |
| 2,179,631 | 11/1939 | Holder | 2/22 |
| 3,304,219 | 2/1967 | Nickerson | 161/162 |
| 3,459,179 | 8/1969 | Olesen | 128/889 |
| 3,503,841 | 3/1970 | Sterret | 161/161 |
| 3,663,344 | 5/1972 | Brock et al. | 161/59 |
| 3,755,063 | 8/1973 | Massey et al. | 161/161 |
| 3,816,234 | 6/1974 | Winfield | 161/160 |
| 4,193,499 | 3/1980 | Lookholder | 206/524 |
| 4,343,047 | 8/1982 | Lazowski et al. | 2/411 |
| 4,472,472 | 9/1984 | Schultz | 2/411 |
| 4,620,633 | 11/1986 | Lookholder | 206/523 |
| 5,134,726 | 8/1992 | Ross | 2/22 |
| 5,397,620 | 3/1995 | Hord, III | 428/142 |
| 5,584,072 | 12/1996 | Kim et al. | 2/22 |

FOREIGN PATENT DOCUMENTS

| | | | |
|---|---|---|---|
| 577328 | 7/1976 | Switzerland | 2/22 |

*Primary Examiner*—Bibhu Mohanty

[57] ABSTRACT

A protective pad to be placed to protect a part of a person's body from injury due to impacts includes two layers of foamed polyethylene spaced a distance apart from each other and a layer of foamed polystyrene granules interposed between the two polyethylene layers. Also included is a garment for securing the protective pad in a position adjacent the part of the person's body subject to injury from impact. The securing apparatus may be a hip garment to protect the hips of a wearer that includes a piece of fabric to fit around the hips of the wearer and pockets attached to the fabric, the pockets holding the protective pad. The protective pad may also be used in a chest garment to protect the chest of a wearer. Also disclosed is a method of making the protective cushioned article of apparel including the steps of forming a cushion package by positioning a layer of polystyrene granules between two sheets of polyethylene, containing the cushion package in a pocket member, and placing the pocket member in an enclosure in the article of apparel.

18 Claims, 4 Drawing Sheets

CUSHIONED PROTECTIVE APPAREL

BACKGROUND OF THE INVENTION

1. Field of Invention

This invention pertains to the art of methods and apparatus for protecting a person's body against injury due to impacts, and more specifically to methods and apparatus for providing protective apparel for protecting a person from injury due to impacts from outside forces or falling.

2. Description of the Related Art

Heretofore padding for apparel has been made from foam or cloth materials. These have provided some degree of protection but improvements are desirable. Traditional commercially available pads are not adequate because they only reduce the impact force to twice the force required to break bones during a routine trip and fall. For elderly people whose bones are more brittle, those at the greatest risk, conventional commercially available pads only reduce the impact force to four times the force required to break bones such as the hip. Cushioning of articles for shipment has been provided by polystyrene foam wrapped in polyethylene film for encapsulating an article to be shipped. Another packaging device includes polystyrene beads glued to a polyethylene web material. However, none of these packaging inventions provides for the dispersion of impact force with a lightweight, disposable, hygienic pad which is provided by the construction of this invention.

The present invention contemplates new and improved protective apparel for protecting the wearer from injury due to impacts which is simple in design, effective in use, and overcomes the foregoing difficulties and others while providing better and more advantageous overall results.

SUMMARY OF THE INVENTION

In accordance with the present invention, a new and improved article of apparel for protecting the wearer from injury due to impacts from outside forces or falling is provided which disperses the force of impact, thus preventing broken bones and other personal injury.

More particularly, in accordance with the present invention a protective article placed to protect a part of a person's body from injury due to impacts includes, a first layer of protective material, a second layer of protective material spaced a distance apart from the first layer, a third layer of protective material interposed between the first layer and the second layer. The third layer is made of granules. A securing apparatus for securing the protective article in a position adjacent the part of the person's body subject to injury from impact is also included.

According to one aspect of the invention, a method of making a protective cushioned article of apparel includes the steps of forming a cushion package by positioning a layer of polystyrene granules between two sheets of polyethylene, containing the cushion package in a pocket member, and placing the pocket member in an enclosure in the article of apparel.

According to another aspect of the present invention a protective pad is provided which includes a first layer of protective material, a second layer of protective material spaced a distance apart from the first layer, and a third layer of protective material interposed between the first layer and the second layer. The third layer is made of granules.

One advantage of the present invention is its capability to disperse enough impact force to protect bones, particularly the hip, from being broken in a fall or as a result of an impact.

Another advantage of the present invention is the applicability of the pad to be used in protective garments.

Another advantage of the present invention is its applicability to be applied to sports equipment such as football helmets.

Another advantage of the present invention is that it is lightweight, limiting its burden to the wearer, particularly the elderly.

Another advantage of the present invention is that it is inexpensive, making it disposable.

Another advantage of the present invention is its applicability to extend the time the impact force is applied and dispersed.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
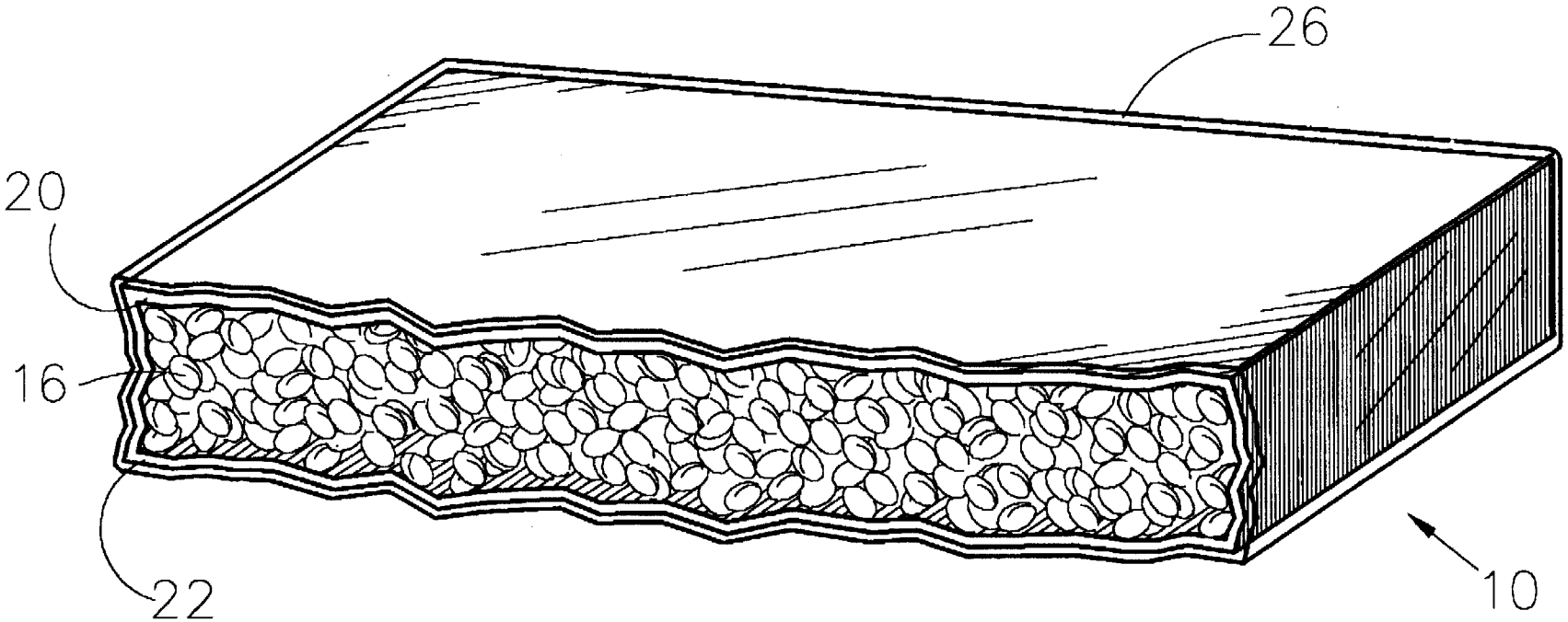
FIG. 1 is a perspective view of a pad according to the invention with parts being broken away.

Referring now to the drawings wherein the showings are for purposes of illustrating a preferred embodiment of the invention only and not for purposes of limiting the same, FIG. 1 shows a perspective, cross-sectional view of a protective pad 10. The pad 10 has a layer of granules 16 sandwiched between two sheets 20,22.

Preferably, the granules 16 are made of foamed polystyrene. The polystyrene granules 16 are preferably round or substantially round in shape, and have a diameter between 1.0 mm and 10.0 mm, and preferably between 2.0 mm and 3.0 mm. While polystyrene is the preferred material for the granules 16, other materials exhibiting lightweight and force dispersing characteristics may also be employed.

Preferably, the sheets 20,22 are made of foamed polyethylene. The polyethylene sheets 20,22 are between 0.5 mm and 5.0 mm thick, preferably 1.0 mm thick. Polyethylene is the preferred material for the sheets 20,22, however, any suitable material may be utilized.

The pad 10 is effective to reduce the force of an impact to the body of the wearer of the pad 10, such as may occur through a fall to a floor. The pad 10 extends the time over which the impact occurs, thereby allowing additional time to disperse impact forces. This impact time extension of the pad 10 is achieved by the pad 10 forming a buffer between the body and the floor, or some other object creating the impact. The extension of time of impact allows the pad 10 to disperse much of the force of impact, reducing the amount of stress placed upon fragile body parts such as hips, particularly in the elderly.

The pad 10 disperses force by transferring the force to the many surfaces of the granules 16 found in the pad 10. Also, the two sheets 20,22 act as baffles that absorb a portion of the force. As the force of the impact is transferred along the many granular surfaces, displacing them relative to each other, the force is dispersed over a greater area throughout the pad 10. The greater the number of small particulate interfaces employed, the greater the dispersion of force. This dispersion is effective to protect areas of a person's body susceptible to injury.

For example, one such area, the greater trochanter found in the hip region, can be protected from the full impactive force that may cause bodily injury. Experimental data available supports the need for and effectiveness of the invention. For example, existing data, generated via simulations reported by Kiel in *New Strategies to Prevent Hip Fractures,"* Hospital Practice 1994, 29:33–40, have determined the force required to produce a hip fracture to be 2,000 newtons with a standard deviation of 1,000 newtons. Therefore, the goal is to produce a protective pad 10 that reduces the force of impact at any one point of the hip to a level below 1000 newtons.

A typical fall may produce an impactive force of up to 6500 newtons on the hip, more than enough to break the hip if the force is directed at the hip. Use of the protective pad 10 can disperse the force and lower the amount of force directed at the hip to about 840 newtons. This level is below the minimum fracture threshold of 1000 newtons, thus preventing hip fracture.

With continuing reference to FIG. 1, in the preferred embodiment, the pad 10 preferably has an outer retaining member 26, such as a thin layer of plastic or any other suitable material, designed to hold the layers of the pad 10 together upon impact.

Figure 2:
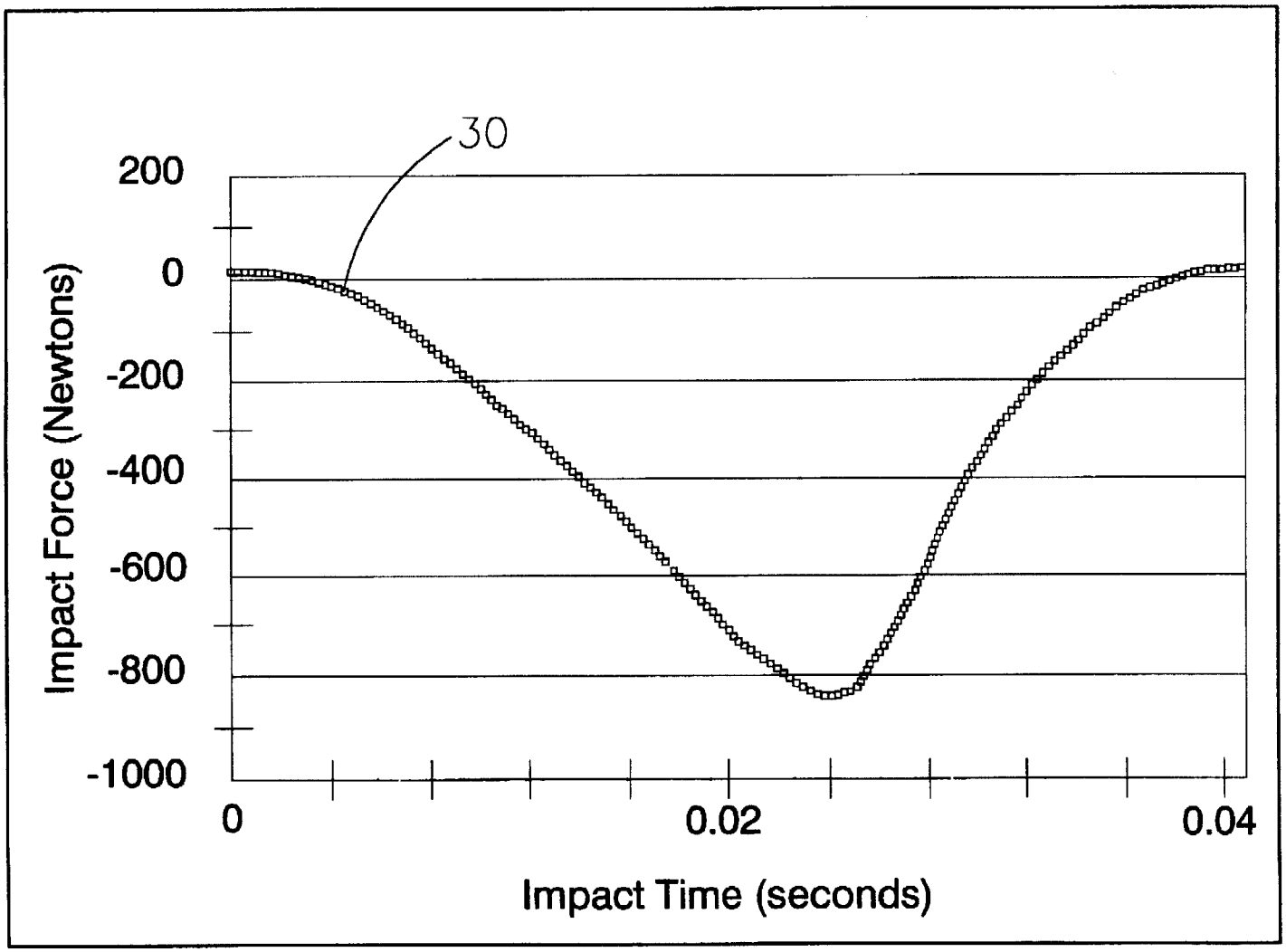
FIG. 2 is a graph of impact force as a function of time for the pad of FIG. 1.

FIG. 2 shows a graph of the dispersed impact force 30 at the protected area expressed in newtons as a function of time into impact, expressed in seconds. As illustrated, as the time into impact increases up to 0.02 seconds, the dispersed impact force 30 increases to the maximum level of 840 newtons, which is below the force which may fracture a hip bone. The dispersion of force over a period of time reduces the maximum force directed at the hip at any one moment.

Figure 3:
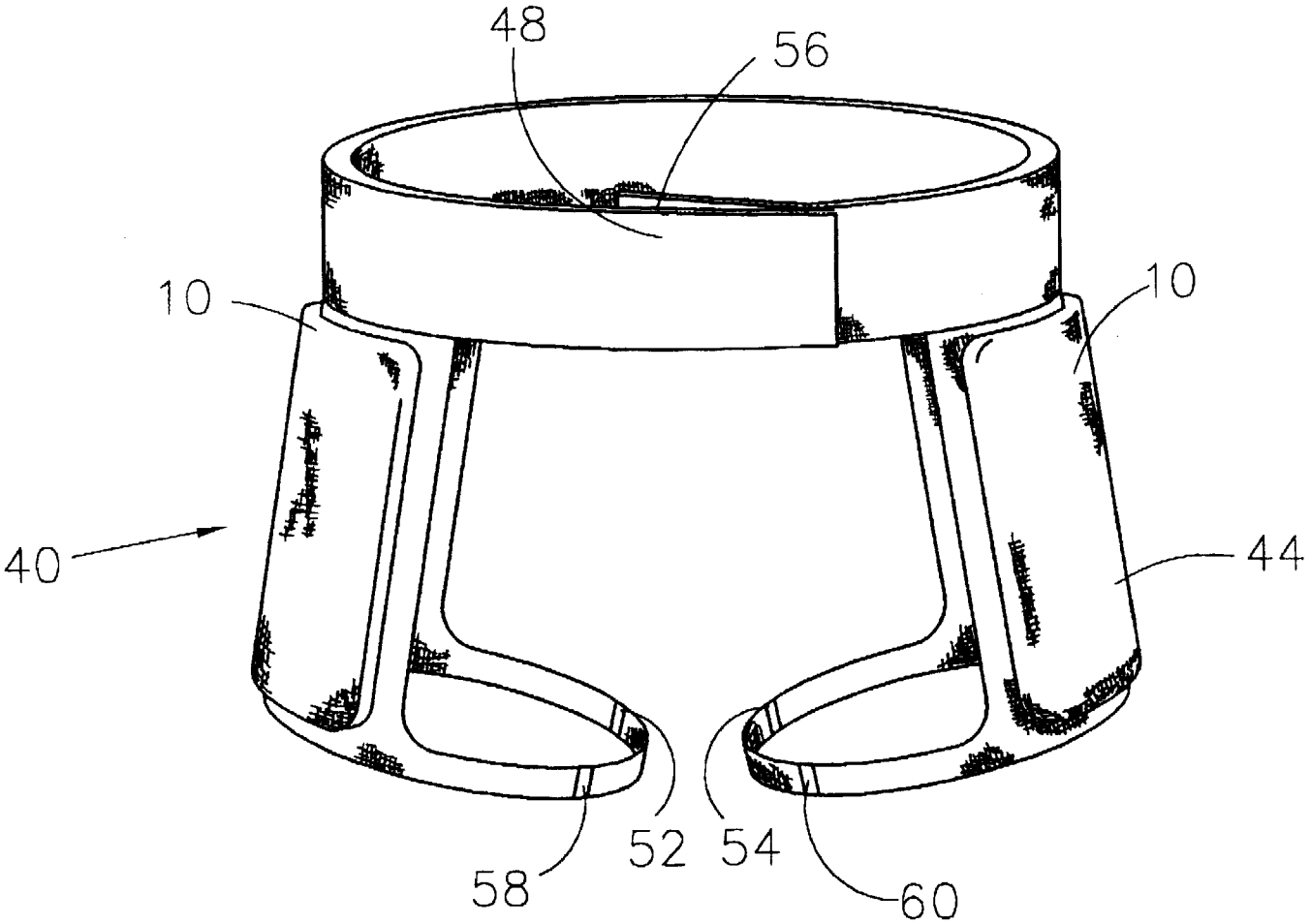
FIG. 3 shows a protective hip garment according to the invention.

FIG. 3 shows one embodiment of an application of the present invention. The pad 10 may be used in conjunction with a hip protection garment 40. The human hip, as stated above, is particularly vulnerable to fractures when persons fall on their side or straight downward, with a leg tucked under the trunk. At particular risk are those with slow gait and poor mobility, such as the elderly. Hip fractures most often occur when a person falls directly on a part of the human hip known as the greater trochanter.

To disperse the force of impact of a fall, the protective pad 10 may be positioned over the greater trochanter in a hip garment 40. Preferably, the pad 10 is fitted into a pocket 44 of the hip garment 40 that is positioned relative to the wearer's body so as to protect the greater trochanter during a fall. The pad may also be attached in any other suitable fashion to the hip garment or to the person's body. The hip garment 40 shown in FIG. 3 has adjustable straps 48,52,54 to hold the hip garment 40 in place. A waist strap 48 fits around the waist of the person, while two leg straps 52,54 fit around the legs of the person. As shown, two pads 10 protect either side of the hip from a fall on either greater trochanter. The straps 48,52,54 are preferably fastened by fasteners 56,58,60, to hold the straps 48,52,54 together. The preferred fasteners 56,58,60 are of hook-and-loop strips fastened to the straps 48,52,54, for example those commonly sold under the name Velcro®. Any other suitable fastener may also be used such as snaps, buttons, drawstrings, or zippers.

Figure 4:
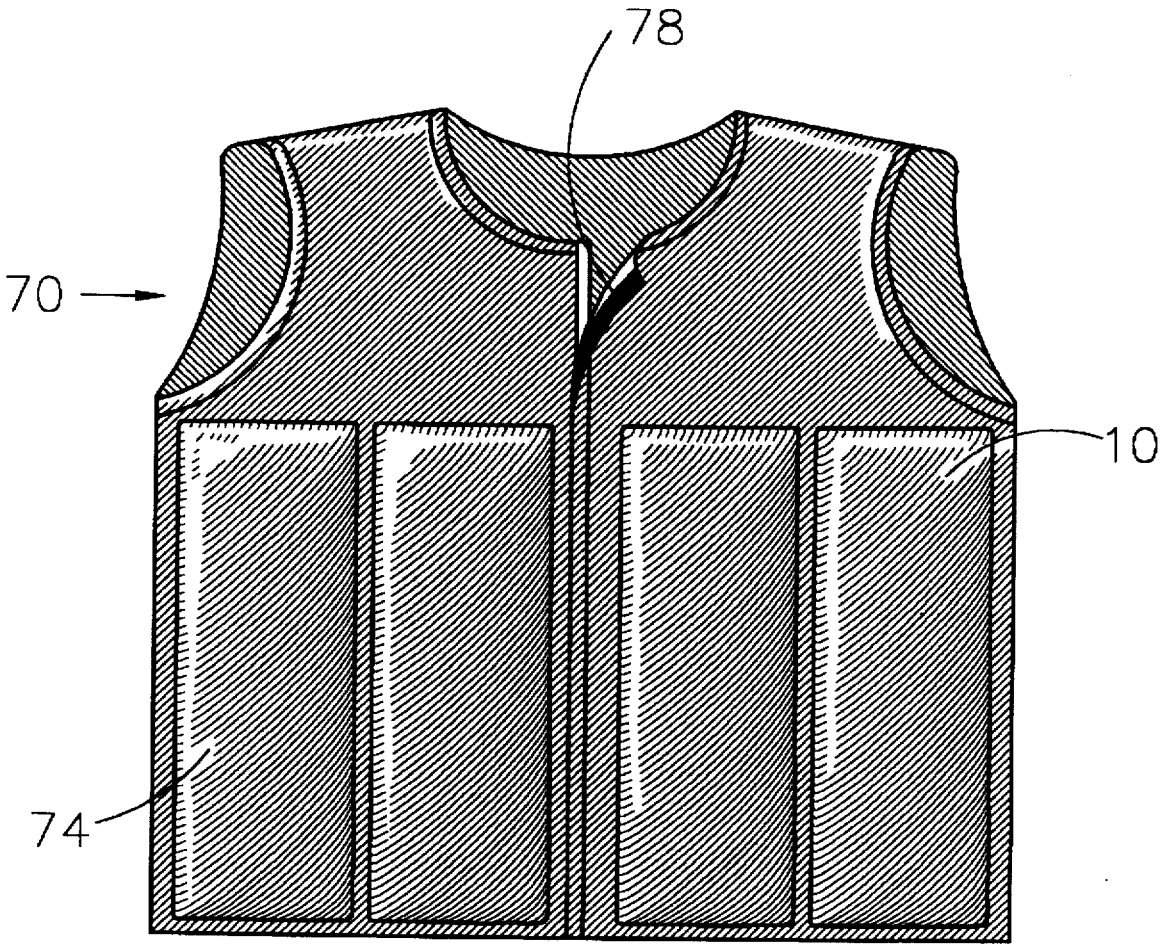
FIG. 4 shows a protective chest garment according to the invention.

Heretofore the present invention has been described with reference to protection of the greater trochanter and hip from the impact of a fall. The pad 10 may also be utilized in further embodiments. FIG. 4 illustrates the pad 10 in a chest garment 70 designed to protect a person's chest region, such as the ribs. The pads 10 are placed in pockets 74 around the chest garment 70, which resembles a vest. The chest garment 70 is preferably fastened snugly to the wearer using a fastener 78 made of hook-and-loop strips that stick together when pressed together, though any other suitable fastener such as snaps, buttons, drawstrings, or zippers may be used. The chest garment 70 is particularly useful to protect those who are suffering from broken ribs, and also may be used to prevent injuries to the ribs.

The protective padding 10 may also be used in protective equipment such as that used in sports. Particularly, the pad 10 may be used in football and baseball helmets to reduce the force of impacts to the head of the wearer. The pad 10 may also be used in football pads, baseball chest protectors, knee and elbow pads, and to protect horseback riders. Also, the pad 10 may be applied to goal posts, backboards, ice rink walls, and anywhere else where a collision is likely to take place. Additionally, the pad 10 may be incorporated in automobiles to help reduce and disperse the impact of automobile collisions. For example, the pad 10 may be incorporated into padding to be used in the doors, ceilings, dashboards, seats, and child safety seats. Finally, the pad 10 may be incorporated into padding for medical applications in such areas to reduce pressure sores on elbows and heels, as well as in hygienic operating table mattress pads.

The preferred embodiments have been described, hereinabove. It will be apparent to those skilled in the art that the above apparatus and methods may incorporate changes and modifications without departing from the general scope of this invention. It is intended to include all such modifications and alterations in so far as they come within the scope of the appended claims or the equivalents thereof.

Having thus described the invention, it is now claimed:

1. A protective article to mitigate the impact force against a predetermined part of a person's body from injury due to an impact, said protective article comprising:

a first layer of foamed plastic;

a second layer of foamed plastic spaced from said first layer;

a third layer of granules interposed between said first layer and said second layer;

an outer retaining member enclosing said first, second, and third layers and holding said layers together upon application of said impact; and, a garment comprising a piece of flexible material to cover the predetermined part of the person's body having a pocket therein for selectively holding said outer retaining member over said predetermined part and fastening means for fastening said material to said body.

2. The protective article of claim 1 wherein at least some of said granules are loose.

3. The protective article of claim 1 wherein said first layer of foamed plastic is comprised of polyethylene.

4. The protective article of claim 3 wherein said second layer of foamed plastic is comprised of polyethylene.

5. The protective article of claim 1 wherein said granules are made of foamed plastic.

6. The protective article of claim 5 wherein said foamed plastic granules are made of polystyrene.

7. The protective article of claim 1 wherein said first layer has a thickness between 0.5 mm and 5.0 mm.

8. The protective article of claim 7 wherein said second layer has a thickness between 0.5 mm and 5.0 mm.

9. The protective article of claim 1 wherein said granules have a diameter between 1.0 mm and 10.0 mm.

10. The protective article of claim 1 wherein said garment is a hip garment and said predetermined part is a hip region.

11. The protective article of claim 1 wherein said fastening means comprises hook-and-loop strips.

12. The protective article of claim 1 wherein said garment is a chest garment and said predetermined part is a chest region.

13. A method of cushioning an article of apparel having a pocket therein and being selectively positioned to cover a predetermined portion of an associated person's body, the method comprising the steps of:

forming a cushion package by positioning a layer of polystyrene granules between first and second baffle members;

containing the cushion package in a retaining member; and, placing the retaining member in said pocket in said article of apparel.

14. An article for protecting a predetermined portion of an associated person's body comprising:

a waist strap for encircling a waist of said associated body;

a first leg strap for encircling a first leg of said associated body;

a piece of flexible material connected to said waist strap and said leg strap and having a first selectively positioned pocket therein; and, a pad assembly positioned in said first pocket, said pad assembly including first and second baffle members and a layer of granules interposed therebetween, and an outer retaining member enclosing said first and second baffle members and said granules.

15. The article of claim 14 wherein said flexible material has a second selectively positioned pocket therein and wherein the article further comprises:

a second pad assembly positioned in said second pocket.

16. The article of claim 14 further comprising:

first fastening means affixed to said waist strap for adjustably fastening said waist strap to said associated body.

17. The article of claim 16 further comprising:

second fastening means affixed to said leg strap for adjustably fastening said leg strap to said associated body.

18. The article of claim 15 further comprising:

a second leg strap connected to said piece of flexible material for encircling a second leg of said associated body.

* * * * *